US007478743B2

(12) United States Patent
Holley, Jr.

(10) Patent No.: US 7,478,743 B2
(45) Date of Patent: Jan. 20, 2009

(54) CARTON FOR TAPERED AND CYLINDRICAL ARTICLES

(76) Inventor: John M. Holley, Jr., 1117 Perimeter Center West, Suite E402, Atlanta, GA (US) 30338

( * ) Notice: Subject to any disclaimer, the term of this patent is extended or adjusted under 35 U.S.C. 154(b) by 0 days.

(21) Appl. No.: 11/712,689

(22) Filed: Feb. 28, 2007

(65) Prior Publication Data

US 2007/0199979 A1 Aug. 30, 2007

Related U.S. Application Data

(60) Provisional application No. 60/777,783, filed on Feb. 28, 2006.

(51) Int. Cl.
*B65D 5/02* (2006.01)

(52) U.S. Cl. ..... 229/103.2; 206/427; 229/136

(58) Field of Classification Search ..... 229/116.1, 229/103.2, 132, 136; 206/427
See application file for complete search history.

(56) References Cited

U.S. PATENT DOCUMENTS 1,516,010 A * 11/1924 Hawxhurst ..... 229/103.2
3,815,735 A 6/1974 Cucuo
4,313,556 A 2/1982 Boyle et al.
4,747,487 A 5/1988 Wood
5,072,876 A * 12/1991 Wilson ..... 229/103.2
5,197,598 A 3/1993 Stout et al.
5,246,112 A * 9/1993 Stout et al. ..... 206/427
5,704,470 A * 1/1998 Sutherland ..... 206/427
6,227,367 B1 * 5/2001 Harrelson et al. ..... 206/427
6,550,616 B2 4/2003 Le Bras
2007/0029220 A1 * 2/2007 Bradford et al. ..... 206/427

FOREIGN PATENT DOCUMENTS

WO WO 02/30785 A1 4/2002
WO WO 2006/017601 A2 2/2006

* cited by examiner

*Primary Examiner*—Gary E Elkins
(74) *Attorney, Agent, or Firm*—Parks Knowlton LLC; Tsugihiko Suzuki

(57) ABSTRACT

A carton is provided with side walls and chamfered corners shaped to securely or tightly enclose a group of cylindrical articles, such as beverage bottles. The curvature of the edges of each side wall is selected to cause the end wall or end closure structure to conform to the cylindrical and tapered shape of articles in the endmost row. More specifically, the end edges of each side wall are substantially concave and their curvature is determined such that the minimum width of each side wall is less than or equal to the width of the top wall. To encourage side end flaps, which partially form the end closure structure, to crease so as to define the chamfered corners, a fold line is formed in the side end flaps.

13 Claims, 3 Drawing Sheets

CARTON FOR TAPERED AND CYLINDRICAL ARTICLES

RELATED APPLICATIONS

This application claims priority to U.S. Provisional Application No. 60/777,783, filed Feb. 28, 2006, the entirety of which is incorporated herein by reference.

TECHNICAL FIELD

This invention relates generally to cartons and, more specifically, to cartons that are shaped to enclose a group of tapered or cylindrical articles.

BACKGROUND OF THE INVENTION

Cartons used to enclose groups of bottles or other cylindrical articles are commonly rectangular boxes with squared corners. Such a rectangular carton includes a top wall that has the same dimensions as its bottom wall, side walls that have the same dimensions as one another, and end walls that have the same dimensions as one another. When a group of cylindrical articles is loaded into a rectangular carton, the articles do not completely fill the rectangular void defined by the interior of the rectangular carton. The empty space or unfilled portion of the void allows the articles to move, slide, or tilt within the carton and, consequently, the articles may damage one another as they contact one another. This problem is particularly acute when the articles are tapered, as are typical beverage bottles.

To address this issue, gabled cartons have been designed to have structures or shapes that better conform to the volume defined by the article group. The gabled shape reduces the unused space as compared to that of rectangular cartons and, thus, the gabled cartons more tightly package the article group. However, many of the blanks for forming gabled cartons include complicated arrangements of fold lines that make it difficult to fold and secure the blank as a tubular structure such that the article group can be end loaded using automated high speed packaging equipment. For example, certain gabled cartons have side walls that each includes a vertically extending lower portion that is hingedly connected to an inwardly sloping upper portion. This shape is not easily maintained when the carton is empty. Thus, the carton must be supported such that the upper portions of the side walls are angled with respect to the lower portions of the side wall so that the group of cylindrical articles can be loaded into the carton. A specialized packaging machine is required to support certain gabled cartons, which introduces an additional cost.

Further, carton structures, shapes, or configurations that include chamfered corners between their end walls and side walls have been developed to tightly package a group of cylindrical articles. For example, such a carton may include an arrangement of triangular panels that connect a side end wall and a side end flap, which partially defines an end wall. However, such an arrangement for providing a chamfered corner is limited to cartons where the upper portions of both side walls and end walls slope inwardly with respect to bottom portions of the side walls and end walls.

Therefore, a heretofore unaddressed need exists in the industry to address the aforementioned deficiencies and inadequacies. What is needed is a carton that tightly packages a group of cylindrical articles and that can be easily erected and loaded according to known methods for forming rectangular cartons.

SUMMARY OF INVENTION

The various embodiments of the present invention overcome the shortcomings of the prior art by providing a carton for tapered or cylindrical articles that can be easily folded and erected from a blank to form a tubular structure having open ends through which a group of articles is easily loaded. The carton includes side end flaps that are scored with portions that provide chamfered corners between the side walls and end walls of the carton such that the carton tightly packages the groups of articles.

Generally described, the carton includes a series of primary panels interconnected along side edges thereof, with end flaps hingedly connected along end edges of certain of the primary panels. The end flaps of the carton can be folded and secured to one another to form end closure structures.

The primary panels include a top wall, a bottom wall, and a pair of opposed side walls hingedly connected to form a tubular structure. Each of the side walls is defined in part by a pair of opposing end edges that are substantially continuously arcuate such that the end edges are curved concavely toward each other. Each of a pair of side end flaps is hingedly connected along one of the end edges of each side wall. Once the carton is erected, the side end flaps form part of the end closure structure for enclosing an end of the tubular structure.

In certain embodiments of the erected carton, each of the side end flaps is uncreased or unscored except for a fold line that extends diagonally upward from a corner defined by a respective one of the side walls and the bottom wall to a point spaced apart from the periphery of the side end flap.

In certain embodiments, each end closure structure carton is also formed from a bottom end flap that is hingedly connected to the bottom wall. The bottom end flap overlaps a distal portion of each one of the pair of side end flaps, the distal portion being defined in part by the fold line.

A proximal portion of each of the pair of side end flaps forms a chamfered corner of the carton, the proximal portion being adjacent to the bottom end flap. The proximal portion is angled with respect to an adjacent one of the pair of side walls and to the end wall.

The fold line in each side end flap controls the point at which the side end flap yields to define the distal portion from the proximal portion.

In certain embodiments, each of the pair of side walls is wider at its bottom edge than it is at its top edge, i.e., each side wall has a length along the bottom wall that is greater than its length along the top wall. This configuration further enables the carton to conform to the shape of cylindrical articles that taper at the top.

A carton blank is also provided. The blank is preferably a unitary portion of a single sheet of material, and can be folded and secured to form the carton. The blank is typically partially erected into a tubular structure with one or both ends remaining open. To form a package, articles are end loaded into the carton in a matrix configuration having at least one row. An endmost row of articles extends along each end closure structure. After the carton is loaded, the side end flaps are folded inwardly until the distal portion is aligned with the end edge of the bottom wall of the carton. The bottom end flap is folded over the distal portion of the side end flap adjacent the terminated fold line, while the proximal portion of each side end flap is exposed. The proximal portion angles or curves around, abuts, or contacts the first and last articles in the endmost row to form the chamfered corners. The curvature of the fold line the hingedly connects a side wall and a side end flap encourages the curve or angle and controls the deformation of the side end flap in part so that the chamfered corner is aesthetically pleasing as well as functional.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Figure 4:
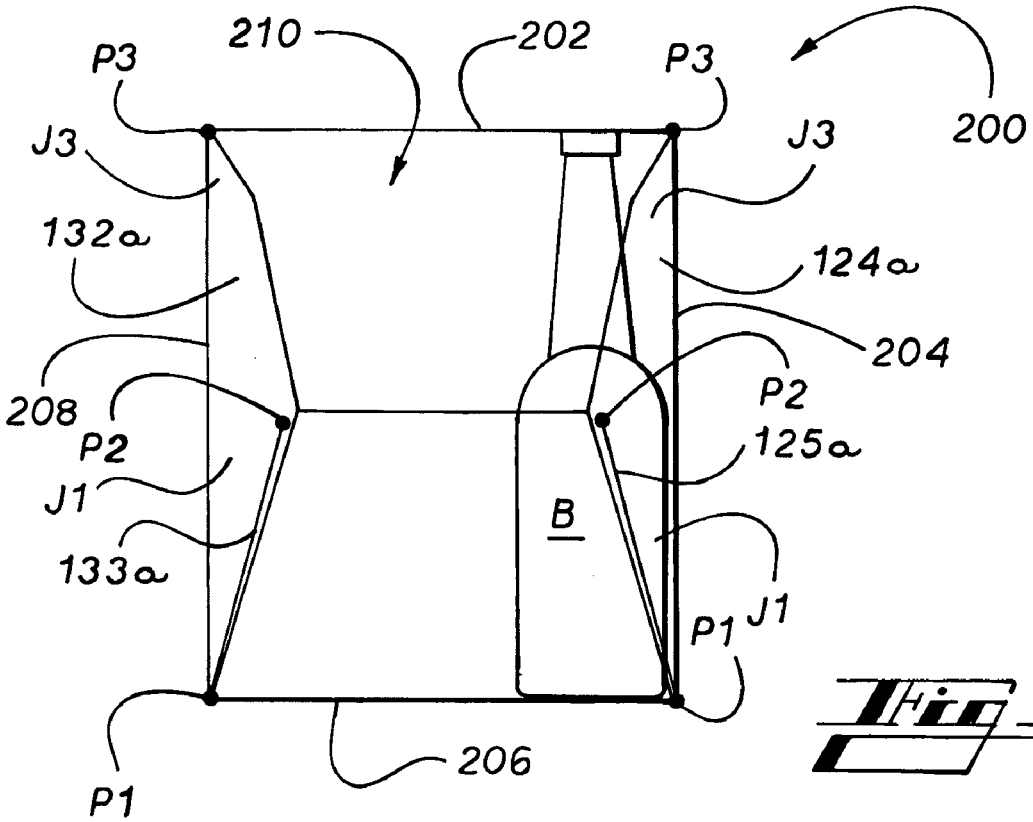
FIG. 4 is an end elevation view of the carton of FIG. 2 showing and enclosed endmost article.
Figure 5:
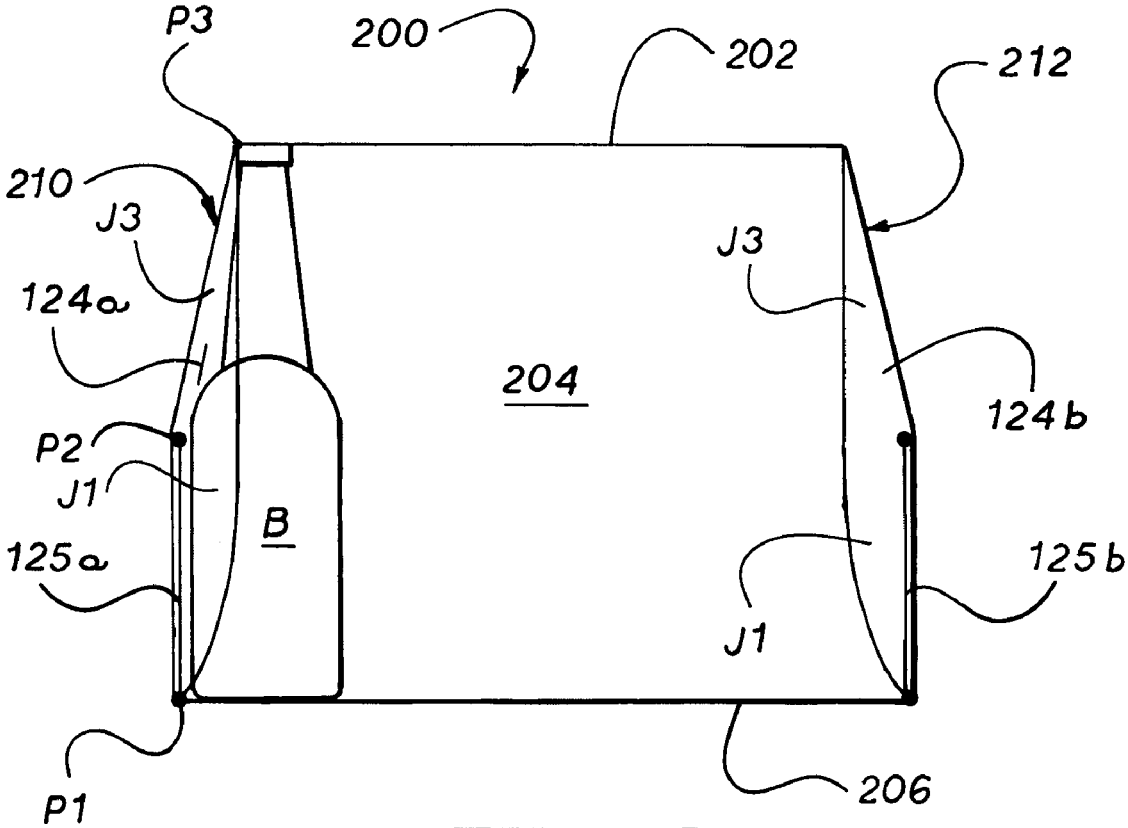
FIG. 5 is a side elevation view of the carton of FIG. 2 showing an enclosed endmost article.

Referring now to the drawings in which like numerals indicate like elements throughout the several views, the drawings illustrate certain of the various aspects of an exemplary embodiment of a carton that includes chamfered corners to tightly package a group of cylindrical articles, according to the present invention. As used herein, the term "cylindrical article" generally refers to an article having a cross-section that may vary in dimension, shape, or size along the length of the article. For purposes of teaching, an exemplary cylindrical article B is illustrated in FIGS. 4 and 5 which has a shape that is similar to known shapes of glass beverage bottles. The exemplary article has a substantially circular cross-section that varies as the articles tapers from a larger lower portion to a smaller upper portion. In alternative embodiments, the shape of the cross-section can be, but is not limited to, a circle, an ellipse, a polygon, combinations thereof, and the like.

Figure 1:
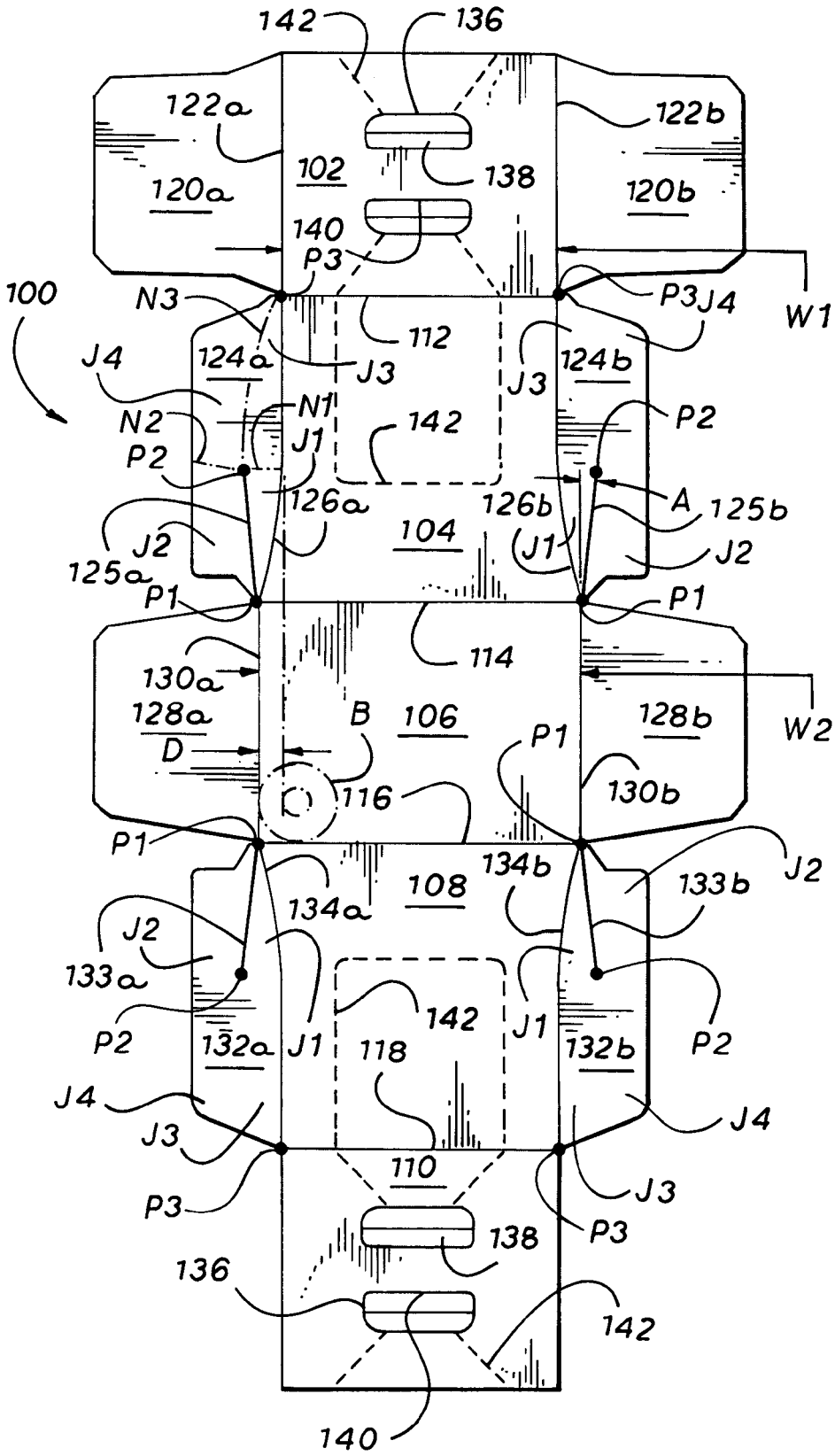
FIG. 1 is a plan view of an exemplary embodiment of a blank, according to the present invention.
Figure 2:
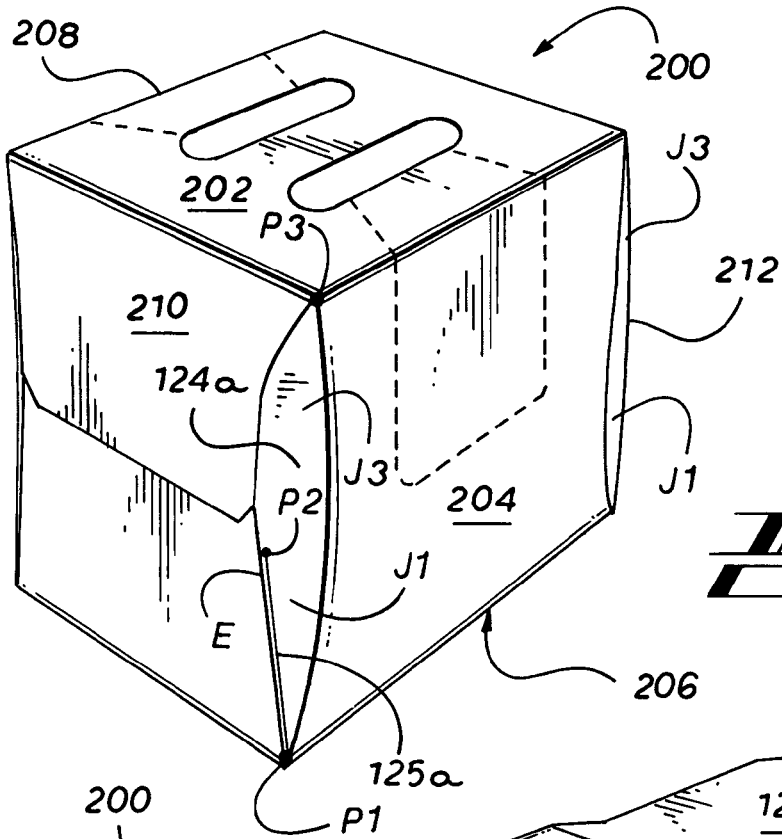
FIG. 2 is a perspective view of an exemplary embodiment of a carton formed from the blank of FIG. 1.

Referring now to FIG. 1, an exemplary embodiment of a blank 100 is illustrated that can be folded and secured to form a carton 200 (shown in FIG. 2). Generally described, the blank 100 is formed from a single sheet of suitable substrate. It is to be understood that, as used herein, the term "suitable substrate" includes all manner of foldable sheet material including paperboard, corrugated board, cardboard, plastic, combinations or laminates of these materials, and the like. In the illustrated embodiment, the blank 100 is unitary, although those skilled in the art will understand that two or more blanks can be employed to form the blank 100 or to form the carton 200.

As used herein, the term "fold line" refers to all manner of lines that define hinge features of the blank, facilitate folding portions of the blank with respect to one another, or otherwise indicate optimal panel folding locations for the blank. A fold line is typically a scored line, an embossed line, or a debossed line.

As used herein, the terms "tear line" and "severance line" refer to all manner of lines along that facilitate separating portions of the substrate from one another or that indicate optimal separation locations. Severance lines may be frangible or otherwise weakened lines, cut lines, or slits.

It should be understood that tear lines, severance lines, and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with varying degrees of weakness to define a fold line and/or a severance line. The line of perforations can be designed to facilitate folding and resist breaking, to facilitate folding and facilitate breaking with more effort, or to facilitate breaking with little effort.

The blank 100 includes a series of primary panels, which define the walls of a tubular structure of the carton 200, as described in further detail below. The primary panels are aligned along a longitudinal axis of the blank 100 and are hingedly connected one to the next along fold lines that extend transversely with respect to the longitudinal axis. Specifically, the primary panels include an outer top panel 102, a first side panel 104, a bottom panel 106, a second side panel 108, and an inner top panel 110. The outer top panel 102 is hingedly connected to the first side panel 104 along a fold line 112, the first side panel 104 is hingedly connected to the bottom panel 106 along a fold line 114, the bottom panel 106 is hingedly connected to the second side panel 108 along a fold line 116, and the second side panel 108 is hingedly connected to the inner top panel 110 along a fold line 118, which defines the top edge of the second side panel 108. It should be noted that, in an alternative embodiment, an edge flap (not shown) may be substituted for the inner top panel 110. In the exemplary embodiment, the bottom panel 106 is substantially wider than the top panels 102, 110. Accordingly, the fold lines 114, 116 are longer than each of the fold lines 112, 118.

End flaps are hingedly connected to opposite end edges of certain primary panels along fold lines that extend substantially parallel to the longitudinal axis. As described in further detail below, the end flaps can be folded and secured to form end closure structures at respective open ends of the tubular structure of the carton 200. The blank 100 is substantially symmetric such that the end flaps that are hingedly connected to the opposite end edges of a primary panel are substantially similar. Accordingly, the end closure structures of the carton 200 are substantially identical and like references have been used with a suffix "a" or "b" affixed thereto to distinguish one end of the carton 200 from the other. The description of an element or group of elements having a suffix "a" is suitable for a like-numbered element or group of elements having a suffix "b". In certain instances, for clarity, only one of the like elements may be described unless a description of the other or both of the like elements is useful for understanding the invention.

A top end flap 120*a* is hingedly connected to the outer top panel 102 along a fold line 122*a*, a first side end flap 124*a* is hingedly connected to the first side panel 104 along a fold line 126*a*, a bottom end flap 128*a* is hingedly connected to the bottom panel 106 along a fold line 130*a*, and a second side end flap 132*a* is hingedly connected to the second side panel 108 along a fold line 134*a*. The side end flaps 124*a*, 132*a* each include longitudinal fold line 125*a*, 133*a*, respectively that extends from a lower corner of the end flap 124*a*, 132*a* towards an upper portion of the end flap 124*a*, 132*a*. Specifically, the fold line 125*a* extends from a corner point P1 adjacent where the fold lines 114, 130*a*, 126*a* intersect to a termination point P2 that is spaced apart from the periphery of the side end flap 124*a*. The fold line 125*a* is substantially straight and extends at an angle A with respect to the fold line 130*a* or otherwise with respect to the longitudinal axis of the blank 100. The angle A is determined so as to position portions of the end flap 125*a*, as described in further detail below. The fold lines 125*b*, 133*a*, 133*b* are dimensioned and positioned on the end flaps 124*b*, 132*a*, 132*b* in a similar manner to that described for the fold line 125*a*.

It should be understood that the fold lines, which hingedly connect panels to end flaps or other panels, define the edges or boundaries of the panels. For example, referring to the first side panel 104, the fold line 112 defines a top edge, the fold line 114 defines a bottom edge, and the fold lines 126*a*, 126*b* define side edges. Hereinafter, the reference numeral of a fold line may be used when referring to an edge defined by that fold line.

For purposes of teaching, notional lines are used to divide the end flap 124*a* into lower corner portion J1, a lower end wall portion J2, an upper corner portion J3 and an upper end wall portion J4. The upper and lower corner portions J1, J3 are proximal to the respective side wall 104, 108, while the upper and lower end wall portions J2, J4 are distal. The lower corner portion J1 is defined by the fold line 125*a*, a lower segment of the fold line 126*a*, and a notional line N1 that extends substantially transversely between the termination point P2 and the fold line 126*a*. The lower end wall portion J2 is defined by the lower distal edge of the end flap 124*a*, a notional line N2 that extends substantially longitudinally between the termination point P2 and the distal edge of the end flap 124*a*, and the fold line 125*a*. The upper corner portion J3 is defined by an upper segment of the fold line 126*a*, the notional line N1 and a notional line N3 that extends substantially longitudinally between the termination point P2 and a point P3 located at the upper corner of the end flap 124*a*. The upper end wall portion J4 is defined by the notional lines N1, N3 and the upper distal edge of the side end flap 124*a*.

It should be understood that the fold lines 125*a*, 126*a* are arranged to position the portions J1, J2, J3, J4 of the end flaps 124*a* with respect to the end most articles B of the group of articles, as described in further detail below. The arrangement of the fold lines 125*a*, 126*a* can be altered or scaled to accommodate articles of different shapes and sizes. Thus, the curvature of the fold line 126*a* is not limited to that described herein and the angle A of the fold line 125*a* is not limited to that described herein.

Continuing with FIG. 1, the exemplary articles B taper from a wider base or lower portion to a narrower neck or upper portion. The taper may be gradual or stepped. For example, a typical beverage bottle has a shoulder that defines the point at which the cross sectional area of the bottle starts to decrease as its upper portion begins to taper. The taper is often subtle at first, essentially rounding off the shoulder, and then much more dramatic, defining the neck of the bottle. Thus, for a group of articles arranged in rows, the width of the group is greater at the base than at the top. The width W1 of the top panel 102 is selected with respect to the width at the top of the group of articles. Similarly, the width W2 of the bottom panel 106 is selected with respect to the width of the base of the group of articles. The end edge 122*a* of the top panel 102 aligns with the edge of the top portion of the article and the end edge 130*a* of the bottom panel 106 aligns with the edge of the base portion of the article. Thus, in the exemplary embodiment, the end edge 122*a* of the outer top panel 102 is offset from the end edge 130*a* of the bottom panel 106 by a distance D.

The fold line 126*a* extends between the points P1, P3 and is curved or angled to bridge the offset distance D between the fold lines 122*a*, 130*a*. The exemplary fold line 126*a* is continuous to facilitate folding the end flap 124*a* there along. It should be understood that the fold line 126*a* is not sharply curved and is otherwise not formed from line segments that come to a sharp point, which would typically cause the end flap 124*a* to crease as the end flap 124*a* is folded along fold line 126*a*. Further, the curvature of the fold line 126*a* is determined such that the end flap 124*a* can be folded, for example, approximately 45 degrees with respect to the first side panel 104.

In the exemplary embodiment the fold line 126*a* includes a substantially linear upper segment and a substantially curved lower segment. The linear upper segment of fold line 126*a* aligns with the fold line 122*a*. The curved lower segment of the fold line 126*a* extends from the linear upper segment to the corner point P1.

It should be understood that the curvature changes at points along the length of fold line 126*a*. In the exemplary embodiment, the curvature at any given point along the linear upper segment fold line 126*a* is approximately zero. In alternative embodiments, the curvature at points along the upper segment is not necessarily zero but is less than the curvature at points along the lower segment. In general, the curvature at points along the length of the fold line 126*a* can be optimized with respect to a associated article.

The outer top panel 102 and the inner top panel 110 further include elements that define a handle and a dispenser. Handle severance lines 136 at least partially define handle flaps or punchouts 138 that are hingedly connected to a respective top panel 102, 110 along handle fold lines 140. Here, the handle is defined by two elliptical shapes and is believed to be comfortable to the user. However, it should be understood that all known handles are contemplated and included in the scope of the invention. The blank 100 further includes severance lines 142 that extend from respective handle severance lines 136 and define a detachable portion of a panel that may be partially or fully torn away to gain access to enclosed articles. As understood by those skilled in the art, the severance lines 142 assist the user with opening the carton and accessing the articles therein. As further understood by one skilled in the art, path of the severance lines 142 or the shape of the detachable portions is merely a design choice.

Erecting the carton 200 from the blank 100 may be accomplished with the folding operations as described herein. The operations can be performed by automatic erecting machinery and/or manually. The method of performing the erecting process is not limited to the exemplary method described herein. Particularly, the order of the steps can be altered according to manufacturing requirements, steps may be added or omitted, and means for securing components to one another may vary. Means for securing the surfaces of sheet material to one another can include tape, staples, interlocking folds, VELCRO®, glue or other adhesives, combinations thereof, and the like.

Figure 3:
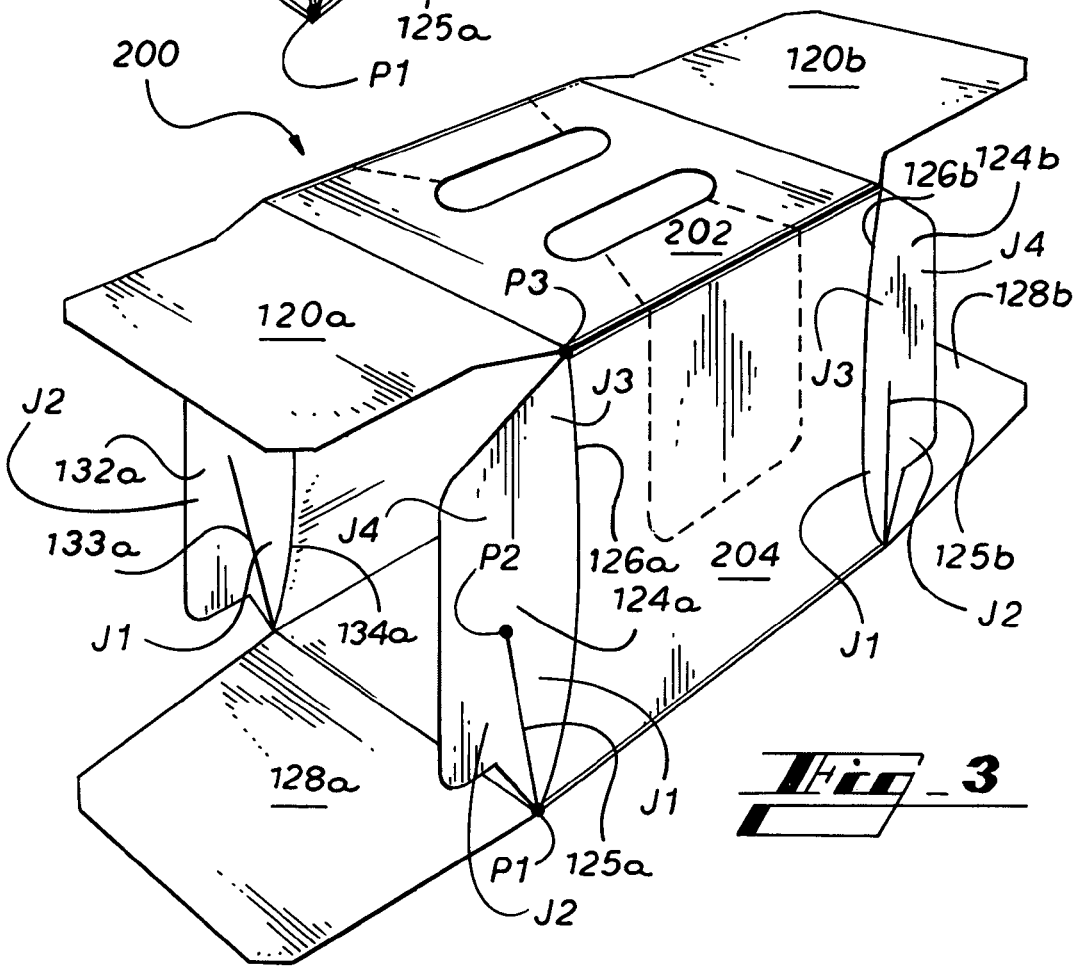
FIG. 3 is a perspective view of the carton of FIG. 2, the carton having been configured as an open ended tubular structure.

Referring to FIGS. 1 and 3, according to an exemplary method, the blank 100 can be folded, secured, and erected such that the primary panels form the wall of an open ended tubular structure. The exemplary method includes folding the blank 100 along the fold lines 114, 118 such that the outer surface of the inner top panel 110 is in flat face contact with the inner surface of the outer top panel 102. Thereby, the distal free edge of the inner top panel 110 is immediately adjacent to the fold line 112 and certain of the features on the outer and inner top panels 102, 110 align to cooperatively define the handle and detachable portions of the carton 200. Glue or other adhesive is applied to one or both of the surfaces of the top panels 102, 110 that are in flat face contact such that the top panels 102, 110 are secured to one another to define a composite top panel 102/110. Thereafter, the blank 100 is configured as a collapsed tubular structure. Referring to FIG. 3, as the collapsed tubular structure is erected to form the tubular structure, the composite top panel 102/110 defines a composite top wall 202, the first side panel 104 defines a first side wall 204, the bottom panel 106 defines a bottom wall 206, and the second side panel 108 defines a second side wall 208. In the exemplary embodiment, each of the side walls 204, 208 is substantially perpendicular to both the top wall 202 and the bottom wall 206. Thereby, the open ends of the tubular structure are substantially rectangular and can easily receive groups of articles therethrough. Further, the erected tubular structure can easily be supported at its sidewalls 204, 208 by vertically extending support surfaces such as those provided by lugs or flight bars on a typical carton conveyor (not shown).

Referring to FIGS. 2 and 3, articles (not shown) are loaded into one or both of the open ends of the tubular structure before folding and securing the end flaps to form end closure structures. Specifically, the side end flaps 124*a*, 132*a* are folded inwardly along fold lines 126*a*, 134*a* such that the lower corner portions J1 contact endmost corner articles B. The side end flaps 124*a*, 132*a* are additionally folded along fold lines 125*a*, 133*a* such that the lower end wall portions additionally contact the endmost corner articles B in the carton 200. Thereby, the lower end wall portions J2 of the side end flaps 124*a*, 132*a* are substantially coplanar with one another and the lower corner portions J1 of the side end flaps 125*a*, 132*a* extend substantially diagonally between the side walls 204, 208 and the distal lower end wall portions J2 of the side end flaps 124*a*, 132*a*. In the exemplary embodiment, the fold lines 125*a*, 133*a* extend from a lower corner of the carton 200, or otherwise from the point P1, such that the coplanar lower end wall portions J2 define a substantially vertical plane. It should be understood that the lower end wall portions J2 are oriented so as to follow, contact, and support the lower portions of articles, which extend substantially vertically.

The bottom end flap 128*a* is folded inwardly along fold line 130*a* to overlap the lower end wall portions J2 of the side end flaps 124*a*, 132*a* and the overlapping portions of the side end flaps 124*a*, 132*a* and the bottom end flap 128*a* are secured to one another. Thus, the bottom end flap 128*a* and the lower end wall portions J2 define a composite lower vertical portion of an end wall 210. In the exemplary embodiment, the lower vertical portion of the end wall 210 is substantially square to the bottom wall 206 and side walls 204, 208.

The top end flap 120*a* is folded inwardly along fold line 122*a* to overlap upper end wall portions J4 of the side end flaps 124*a*, 132*a* and to overlap a distal end portion of the bottom end flap 128*a*. The overlapping portions of the top end flap 120*a* and the end flaps 124*a*, 132*a*, 128*a* are secured to one another. Thus, the top end flap 120*a* and the distal upper end wall portions J4 define a composite upper portion of the end wall 210 that extends between the top wall 202 and the vertical lower portion of the end wall 210.

Thereafter, referring to FIGS. 2, 4, and 5 the end flaps form end closure structures where the overlapping portions of the end flaps define end walls 210, 212 of the carton 200 and portions J1, J3 of the side end flaps 124*a*, 124*b*, 132*a*, 132*b* define chamfered corners between the end walls 210, 212 and the side walls 204, 208. In the exemplary embodiment, the lower corner portion J1 is defined so as to be dimensioned and positioned to abut the lower portion of a corner article B of the group of articles. The lower portions of corner articles B are abutted by an adjacent side wall, end wall, and chamfered corner, thereby providing support or otherwise tightly packaging the group of articles. Thus, by conforming to the shape of the endmost corner articles, the carton 200 offers a tighter fit and discourages tilting of the articles within. It should be understood that tilting articles may result in undesirable clinking that can damage the articles or scuff the labels affixed thereto.

It should be understood that, in alternative embodiments, the bottom end flap 128*a* can be the outside overlapping layer with respect to the top end flap 120*a* or the top end flap 120*a* and the bottom end flap 128*a* may not overlap.

Referring to FIGS. 4 and 5, the arrangement of fold lines that define the chamfered corner is described in further detail with respect to a corner end most article. For clarity, certain features, such as severance lines 142 are omitted, and the relationship between the walls and the articles may be exaggerated somewhat to show detail. A single corner endmost article is shown, although in practice the carton 200 would be fully loaded.

The contour of each of the end edges 126*a*, 134*a* of the side walls 204, 208 is substantially concave; i.e., the end edges of the side walls 204, 208 curve inwardly toward one another.

Referring to FIG. 5, it should be noted that part of the edge 126*a* of the side wall 204 is inside the outermost edge endmost article B. In general, where the edge 126*a* is increasingly inside the outermost edge of the endmost article B, a greater portion of the chamfered corner, as defined by side end flap portions J1, J3 is in contact with, wraps around, or abuts the endmost article B. Thus, it should be understood that the position of the edge 126*a* can be optimized for any cylindrical article, for example, to contact different portions of an article or to contact more or less of the surface of an article.

The curved lower segment of the fold line 126*a* provides that the edge 126*a* is inside the outermost edge of the endmost article B by a distance along the length of the article that is greater, for example, than the distance that would be provided if the curved lower segment were straight. Thus, the curvature of the fold line 126*a* provides that the lower corner portion J1 can have an increased width and that the fold line 126*a* can be easily folded.

The present invention has been illustrated in relation to a particular embodiment which is intended in all respects to be illustrative rather than restrictive. Those skilled in the art will recognize that the present invention is capable of many modifications and variations without departing from the scope of the invention. For example, although cylindrical articles are described, a carton according to the current invention may enclose any type of article. In addition, directional references used herein, such as "top", "bottom", "end", "side," "inner", "outer", "upper", "middle", "lower", "front" and "rear," do not limit the orientation of the respective panels and walls with respect to one another. Any reference to hinged connection should not be construed as necessarily referring to a single fold line only; indeed, it is envisaged that hinged connection can be formed from one or more of one of the following, a score line, a frangible line or a fold line, without departing from the scope of the invention. Those skilled in the art will also appreciate that the shapes and sizes of the panels, flaps and handles are only examples of the various configurations that will be suitable for implementation of the various embodiments of the invention.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. An end loaded carton for enclosing a plurality of articles, said carton comprising:

a tubular structure comprising a pair of opposed side walls, each of said side walls comprising a pair of opposing end edges that are at least partially curved concavely toward each other; and an end closure structure for at least partially closing an end of said tubular structure, said end closure structure comprising a pair of side end flaps, each of said side end flaps being hingedly connected to a respective one of said side walls along one of said end edges, said end closure structure comprising an end wall and a pair of chamfered corners;

wherein each of said side end flaps comprises a terminated fold line that extends from a first point that is located approximately at a lower end point of a respective one of said end edges to a second point that is spaced apart from the periphery of a respective one of said side end flaps.

2. The carton of claim 1, said tubular structure further comprising a bottom wall, said end closure structure further comprising a bottom end flap hingedly connected to said bottom wall, each of said side end flaps comprising a distal lower end wall portion that is defined in part by a respective terminated fold line, wherein said bottom end flap overlaps said distal lower end wall portion of each of said side end flaps.

3. The carton of claim 2, each of said pair of side end flaps comprising a proximal lower corner portion that is defined in part by a respective terminated fold line and is adjacent to a respective distal lower end wall portion, wherein each proximal lower corner portion forms at least part of one of said chamfered corners.

4. The carton of claim 3, wherein said proximal lower corner portion of each side end flap is angled with respect to an adjacent one of said side walls and with respect to said end wall.

5. The carton of claim 1, said tubular structure further comprising a top wall, said end closure structure further comprising a top end flap hingedly connected to said top wall, each of said side end flaps comprising a distal upper end wall portion, wherein said top end flap overlaps said distal upper end wall portion of each of said side end flaps.

6. The carton of claim 5, each of said pair of side end flaps comprising a proximal upper corner portion that is adjacent to a respective distal upper end wall portion, wherein each proximal upper corner portion forms at least part of one of said chamfered corners.

7. The carton of claim 6, wherein said proximal upper corner portion of each side end flap is angled with respect to an adjacent one of said side walls and with respect to said end wall.

8. The carton of claim 1, the tubular structure further comprising a top wall and a bottom wall, wherein the width of said bottom wall is greater than the width of said top wall.

9. A blank for forming a carton, the blank comprising:

a plurality of panels hingedly connected one to the next that can be arranged to form a tubular structure, the plurality of panels comprising at least one side panel comprising a pair of end edges that are curved concavely toward each other; and a pair of side end flaps for at least partially defining end closure structures at opposite ends of said tubular structure, said end flaps being hingedly connected to respective ones of said end edges;

wherein each of said end flaps includes a terminated fold line that extends from a first point that is located approximately at an end point of a respective one of said end edges to a second point that is spaced apart from the periphery of a respective one of said side end flaps.

10. A package, comprising:

a group of cylindrical articles each having a relatively larger bottom portion and a relatively smaller top portion, said articles being arranged in one or more rows; and a carton enclosing said article group, said carton comprising:

a tubular structure comprising a pair of opposed side walls, each of said side walls comprising a pair of opposing end edges that are at least partially curved concavely toward each other; and an end closure structure for at least partially closing an end of said tubular structure, said end closure structure comprising a pair of side end flaps, each of said side end flaps being hingedly connected to a respective one of said side walls along one of said end edges, said end closure structure comprising an end wall and a pair of chamfered corners;

wherein each of said side end flaps comprises a terminated fold line that extends from a first point that is located approximately at a lower end point of a respective one of said end edges to a second point spaced apart from the periphery of a respective one of said side end flaps.

11. The package of claim 10, wherein a curvature of said end closure structure provided by associated ones of said end edges and chamfered corners conforms to the taper of the articles that are adjacent to said end closure structure.

12. The package of claim 10, wherein said second point on each of said side end flaps to which a respective one of said fold lines extends is positioned substantially at the height of a shoulder of each of said articles.

13. The package of claim 10, wherein a portion of an article that is adjacent to said end closure structure extends outwardly beyond a respective one of said end edges of each of said side walls.

* * * * *